US010201906B2

(12) United States Patent
Greenleaf

(10) Patent No.: US 10,201,906 B2
(45) Date of Patent: Feb. 12, 2019

(54) FLEXIBLE GRIP DIE-ALIGNMENT ARRANGEMENT

(71) Applicant: Richard J. Greenleaf, Manchester, MA (US)

(72) Inventor: Richard J. Greenleaf, Manchester, MA (US)

( * ) Notice: Subject to any disclaimer, the term of this patent is extended or adjusted under 35 U.S.C. 154(b) by 134 days.

(21) Appl. No.: 15/530,236

(22) Filed: Dec. 14, 2016

(65) Prior Publication Data

US 2017/0100850 A1 Apr. 13, 2017

Related U.S. Application Data

(60) Continuation-in-part of application No. 14/544,416, filed on Jan. 2, 2015, now Pat. No. 9,561,534, which is a division of application No. 12/924,139, filed on Sep. 21, 2010, now Pat. No. 8,925,435, which is a continuation-in-part of application No. 12/214,924, filed on Jun. 24, 2008, now abandoned.

(51) Int. Cl.

| | |
|---|---|
| ***B26F 1/14*** | (2006.01) |
| ***B26D 7/26*** | (2006.01) |
| ***B21D 28/34*** | (2006.01) |

(52) U.S. Cl.

CPC ..... *B26F 1/14* (2013.01); *B21D 28/34* (2013.01); *B26D 7/26* (2013.01); *B26D 7/2628* (2013.01); *Y10T 83/9423* (2015.04)

(58) Field of Classification Search

CPC ..... B21D 37/04; B21D 28/34; B21D 28/26; Y10T 83/9423; Y10T 403/5761; A47B 91/024; F16B 5/008; B26F 1/14; B26D 2007/2607; B26D 7/2614; B26D 7/26; B26D 7/2628

USPC ..... 409/309, 314; 83/684, 698.91; 403/366

See application file for complete search history.

(56) References Cited

U.S. PATENT DOCUMENTS

| | | | | | |
|---|---|---|---|---|---|
| 245,696 | A * | 8/1881 | Black | A47B 91/024 | 285/323 |
| 288,746 | A * | 11/1883 | Vielhaber | F16G 11/04 | 403/314 |
| 691,448 | A * | 1/1902 | Cowell | A47B 91/024 | 403/309 |

* cited by examiner

*Primary Examiner* — Jennifer B Swinney
(74) *Attorney, Agent, or Firm* — Don Halgren

(57) ABSTRACT

A tool gripping and alignment plate arrangement, for accurately gripping and holding a tool in perfect alignment. The alignment plate arrangement comprises a flat unitary tool gripping plate. An irregular bore opening is formed in the tool gripping plate, for gripping a tool therein. The irregular bore wall opening is comprised of a first wall portion of 180 degrees in circumference, and a distortable second wall portion of less than 180 degrees in circumference. A bore-facing tool relief portion is arranged on a distal end of the distortable second wall portion.

5 Claims, 2 Drawing Sheets

FLEXIBLE GRIP DIE-ALIGNMENT ARRANGEMENT

BACKGROUND OF THE INVENTION

Field of the Invention

This invention relates to punch press assemblies and more particularly to center punch holder plate tool-holding grip arrangements for gripping tools to permit very accurate alignment arrangements to facilitate the alignment of opposing tools utilized to pierce a sheet of material such as for example in a punch press, and is a continuation-in-part of application Ser. No. 14/544,416, filed Jan. 2, 2015, now U.S. Pat. No. 9,561,534, which is a continuation of application Ser. No. 12/924,139, filed Sep. 21, 2010, now U.S. Pat. No. 8,925,435, each incorporated herein by reference in their entirety.

Discussion of the Prior Art

Compound tooling is currently utilized by hundreds of manufacturers to produce thousands of different types of washers made from aluminum, brass, copper, nylon, steel utilized in almost everything society touches. Washers are for example, utilized in any product with nuts and bolts or moving parts. The inside diameter and the outside diameter of these washers or other punched parts have become more critical and significant for use in the manufacture of high-quality precision devices.

Prior art tool and die sets have to be made slightly loose, and those tools use clamping screws which thus influences a die in a tool holder. That in turn establishes inaccuracies and a loss of concentricity of the alignment of those tools.

It is an object of the present invention to overcome the disadvantages of the prior art.

It is a further object of the present invention to provide a tool set in which the punch and die members are in exact accurate concentric alignment with one another.

It is a further object of the present invention to provide a unique and simple center punch die holder plate arrangement of that tool set in which a tool gripping and alignment plate firmly grips a tool in a biasable irregular opening, which, when biased forms a near-perfect circle for gripping the tool, especially useful in die punching operations.

BRIEF SUMMARY OF THE INVENTION

The present invention comprises a tool holder arrangement for the manufacture of punched parts from a traveling web or sheet of material such as metal or plastic to produce washers or the like, as recited in my aforementioned U.S. Pat. No. 8,925,435 incorporated hereinabove by reference.

The die set assembly or arrangement of the present invention comprises a compound punch holder plate which would be bolted to the under side of the die shoe of a punch press.

A die set arrangement typically comprises an upper portion which comprises the upper punch holder plate. The upper punch holder plate is disposed parallel to and reciprocably movable with respect to the stripper holderplate on the base portion of the die set arrangement. The punch holder plate is supported on guide pins which are received in guide bushings at their lowermost end. A center punch holder plate is bolted to the lower side of the punch holder plate. The center punch holder plate has a bore which adjustably arranged about a center punch there within. A die holder plate is supported by those same pins onto the lower side of the center punch holder plate. The die holder plate has a central opening of a third diameter. The opening in the die holder plate is arranged to adjustably enclose and align a die member therewithin. The die holder plate has a central opening which encloses an annular knockout member. The annular knockout member has a central bore through which the center punch, supported at its upper end by the center punch holder plate, is supported.

Reciprocating motion of the upper portion of the die set arrangement, with its die arranged downwardly therefrom, impacting the stripper holder plate supported on the lower portion of the die set arrangement, with a traveling web of material moving therebetween, effects the manufacture of a punched part by virtue of the center punch and the die mating with the compound punch and its associated stripper holder.

The concentric alignment each of these components is critical to the manufacture of a proper punched part.

The center punch holder plate and the die holder plate in the uppermost portion of the die set arrangement, and the stripper holder plate and the compound punch holder plate in the lower portion of the die set arrangement, each utilize a flexible grip arrangement to secure the tool components within their commonly aligned bores.

The center punch holder plate of the present invention has a central bore for squeezably pinching and holding a tool concentrically therewithin, with respect to adjacent tool holding plates. The central bore in the exemplary center punch holder plate is slightly out of round at one side location thereof. That side location also includes the beginning or distal end of a curvilinear cut through the center punch holder plate which curvilinear cut extends in a generally semi-circular or somewhat "J" shaped pattern around the central bore. That generally semicircular cut extends from the bore wall, and around the bore at least 180° therearound, looking somewhat liked a "J" shaped "curved finger". In one embodiment of that semicircular cut, the second or proximal end of that cut curves slightly radially outwardly and away from the center of that central bore within the center punch holder plate, and has a different center of curvature from its opposite side of that bore.

A threaded bore is arranged through the side edge of the exemplary center punch holder plate and extends up to the radially outer surface of that generally semi circular cut, meeting the cut at a location of about one third the distance from the distal end of that cut. An adjustment bolt is disposed within that threaded bore so as to effect (or release) a bias on the radially outward side of the cut, when that adjustment bolt is rotated within that bore. That generally semicircular cut through the exemplary center punch holder plate in effect creates a "flexible grip" finger. A bias inwardly by the adjustment bolt against the finger presses a semicircular curved wall portion of that finger slightly inwardly radially, so as to distort the irregular bore and hence create a perfect circular hole in that central bore. When for example, a tool such as a center punch is placed within the center punch holder plate, and the adjustment bolt is tightened with respect to that finger, the center punch is now squeezed tightly within a distorted bore which now, after tightening by the adjustment bolt, now effects a perfect circular hole therewithin. By aligning the respective center bores of the adjacent holder plates within the upper portion and the lower portion of the die set arrangement, the matable tool components therein may be held in perfect axial alignment.

In one preferred embodiment of the present invention, the center punch holder plate, the die holder plate, the stripper holder plate and the compound punch holder plate may have an initial or pilot bore drilled therethrough to establish the initial alignment thereof. The slight irregularity of those respective bores may be machined when the generally semicircular cut is made in each respective holder plate. Thus when a tool is clamped within respective holder plate, that bore within that holder plate becomes a perfect circle. When no tool is clamped within the respective holder plates, the bore within those respective holder plates is irregular and "out of round" in its undistorted/unbiased configuration.

The center punch holder plate comprising the present invention is thus a block or plate having a tool gripping bore extending generally centrally therethrough. The tool gripping bore has a first half circle of arcuate configuration of 180° going from a $1^{st}$ point "A" to a $2^{nd}$ point "B" on that bore. The $1^{st}$ arcuate configuration has a $1^{st}$ center of curvature "Y". The tool gripping bore has a $2^{nd}$ arcuate configuration of almost a half circle going from the $2^{nd}$ point "B" on that bore to a $3^{rd}$ point "E" on that bore. The $2^{nd}$ arcuate configuration extends to the $3^{rd}$ point "E" which is slightly less than one hundred and eighty degrees (180°) from the $2^{nd}$ point on the bore.

The $2^{nd}$ arcuate configuration is comprised of a bore-facing-side of the generally "J" shaped finger identified in the aforementioned patent. That "J" shaped finger being formed by a cut of generally "J" shape through the block or plate as afore described.

The "J" shaped finger has a distal end with a tool relief bore-facing "sloped away" planar surface thereon beginning at the $3^{rd}$ point "E" on the bore, which $3^{rd}$ point is about one hundred and sixty degrees (160°) from the $2^{nd}$ point "B" on the bore. The tool relief bore facing planar surface is arranged at an angle of about 10 to 15° with respect to the curvature at the $3^{rd}$ point of the bore. The "sloped away" planar surface provides a segment of empty space or relief to facilitate entry of a tool within that bore.

A "J" finger-adjustment-bolt may be threaded through a threaded bore on the side of the center punch holder plate to provide careful inwardly biased adjustment of the "J" shaped finger around a tool within the bore. When an adjustment bolt abuts against and pushes the J shaped finger into close contact with a tool within the bore, the two different centers of curvature for the respective portions of the bore periphery, come into common concentric alignment.

A keyway is arranged through the center punch holder plate. which keyway tangentially forms a slight opening in the surface of the $1^{st}$ semicircular (non-movable portion) configuration of the bore. The keyway extends across the center punch holder plate and is of non-circular configuration so as to better receive a key which would be pushed therethrough. The non-circular configuration is preferably of generally square shape, however, having rounded corners therealong. The non-circular keyway is made within the center punch holder plate by a cutting wire passed through a pre-made bore. The cutting wire would form the generally non-circular (transverse) shape of the keyway by electrical discharge against the metal of the center punch holder plate.

The invention thus comprises a tool gripping and alignment plate arrangement, for accurately gripping and holding in perfect alignment, a tool placed therein, comprising a flat unitary tool gripping plate; an irregular bore opening formed in the tool gripping plate, for gripping a tool therein, the irregular bore wall opening having a half circle curved first wall portion with a first center of curvature, and a curved "J" shaped member with a curvilinear bore second wall portion having a separate second center of curvature; a sloped relief-portion arranged on a distal end of the "J" shaped member to facilitate entry of a tool into the bore opening prior to a distortion of the "J" shaped member into circular concentricity with the first curved portion of the bore opening. A biasing member is arranged for biasably distorting the "J" shaped member on the irregular bore opening in the tool gripping plate from a non-circular shape into a circular shaped opening for circumferentially gripping a tool therein. The sloped relief portion is arranged at an angle of between to 10 to 15 degrees with respect to the wall portion of the "J" shaped member. The sloped portion begins on the "J" member from about 160 degrees from the first half circle. A keyway is arranged across the tool gripping plate, extending through the wall of the bore in the first half circle. The keyway is of non-circular cross-section. The keyway is of square shape in cross-section. The keyway has rounded corners. The keyway has an elongated slot extending across the first wall portion.

The invention thus also comprises a tool gripping and alignment plate arrangement, for accurately gripping and holding a tool in perfect alignment, comprising: a flat unitary tool gripping plate; an irregular bore opening formed in the tool gripping plate, for gripping a tool therein, the irregular bore wall opening comprised of a first wall portion of 180 degrees in circumference, and a distortable second wall portion of less than 180 degrees in circumference, with a bore-facing tool relief portion on a distal end of the distortable second wall portion. The first wall portion and the second wall portion each have independent centers of curvature when the irregular bore is in an non-distorted state. The first wall portion and the second wall portion each have common centers of curvature when the irregular bore is in a distorted state. The second wall portion is comprised of a "J" shaped biasable finger. The "J" shaped biasable finger has a sloped relief portion thereon at a bore-facing distal end thereof. The sloped relief portion is arranged at an angle of about 10 to 15 degrees with respect to the curvilinear bore facing wall thereat.

BRIEF DESCRIPTION OF THE DRAWINGS

The objects and advantages of the present invention will become more apparent when viewed in conjunction with the following drawings, in which.

DETAILED DESCRIPTION OF THE PREFERRED EMBODIMENTS

Figure 1:
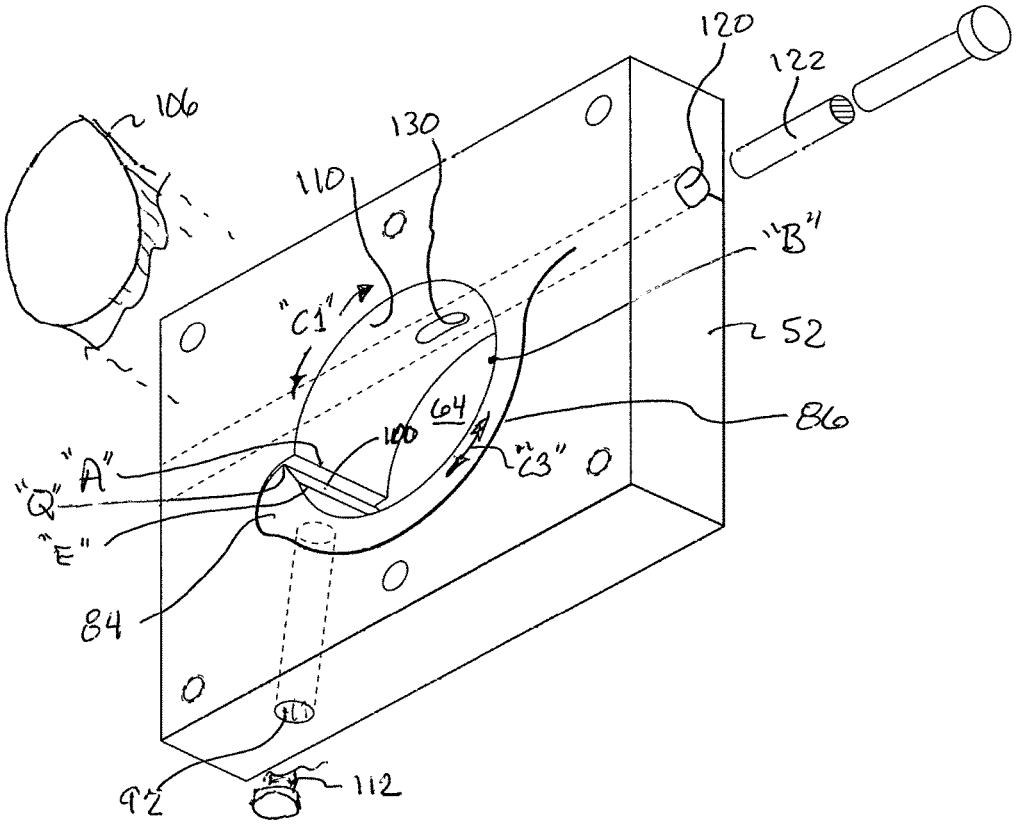
FIG. 1 is a perspective view of a center punch holder plate utilized to surround a tool in a die set cutting assembly arrangement.
Figure 2:
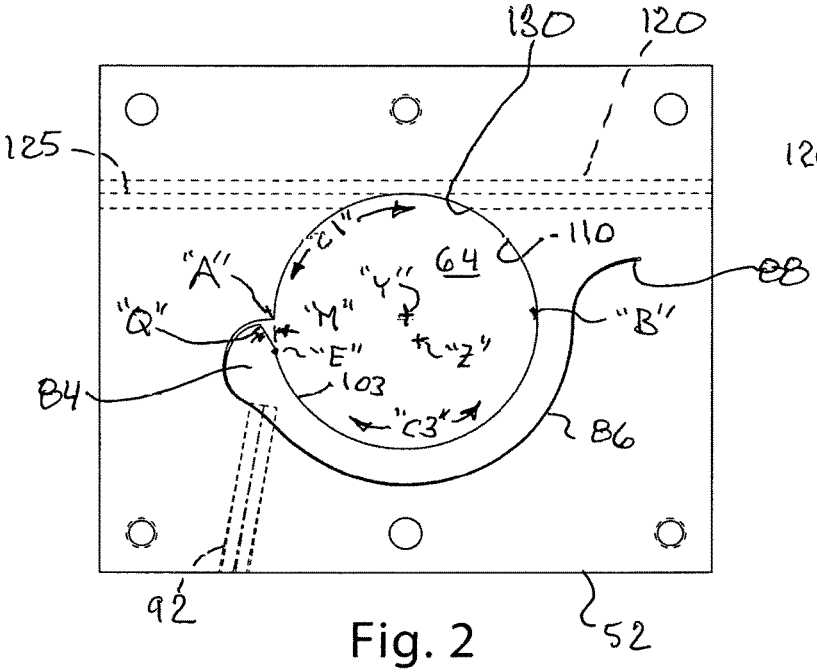
FIG. 2 is a plan view of the center punch holder plate shown in FIG. 1.

Referring now to the drawings in detail, and particularly to FIG. 1, there is shown a center punch holder plate 52 of the present invention has a central bore 64 for squeezably pinching and holding a tool 106 (only partially shown in FIG. 1) concentrically therewithin, with respect to adjacent tool holding plates. The central bore 64 in the exemplary center punch holder plate is slightly out of round at one "almost" semi-circular side location 103 thereof, as represented in FIG. 2 which extends from "E" to "B". "A" and "B" are 180 degrees apart on the inner bore 64 defining "C1". That almost semi-circular side location 103 "C3" also includes the beginning or distal end of a curvilinear cut 86 through the center punch holder plate 52 which curvilinear cut 86 extends in a generally semi-circular or somewhat "J" shaped pattern around the central bore 64, as may be seen in FIGS. 1 and 2. That generally semicircular cut 86 extends from the bore wall at point "A", and around the bore at least 180° therearound, looking like and creating somewhat like a "J" shaped "curved finger" 84. In one embodiment of that semicircular cut 86, the second or proximal end 88 of that cut 86 curves slightly radially outwardly and away from the center of that central bore 64 within the center punch holder plate 52, and has a different center of curvature "Z" from the center of curvature "Y" on the opposite side 110 of that bore 64, as represented somewhat exaggeratedly in FIG. 2.

Figure 4:
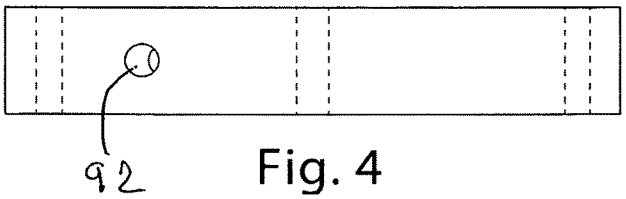
FIG. 4 is a second (lower shown) side view of the center punch holder plate shown in FIG. 2.

A threaded bore 92 is arranged through the side edge of the exemplary center punch holder plate 52, as represented in FIGS. 1, 2 and 4, and extends up to the radially outer surface of that generally semi circular cut 86, meeting the cut 86 at a location of about one third the distance from the distal end of that cut 86, as shown in FIG. 2. An adjustment bolt 112 is disposed within that threaded bore 92 so (when turned) enables (or releases) a bias on the radially outward side of the cut 86, when that adjustment bolt 92 is rotated within that bore 64. That generally semicircular cut 86 through the exemplary center punch holder plate 52 in effect creates a "flexible grip" finger 84. A bias inwardly by the adjustment bolt 112 against the finger 84 presses the semicircular curved wall portion 103 of that finger 84 slightly inwardly radially, so as to distort the irregular bore into a non-irregular bore and hence create a perfect circular hole in that central bore 64, except for the "relief" portion 100 of the bore wall. When for example, a tool 106 such as a center punch, for example, is placed within the center punch holder plate 52, and the adjustment bolt 112 is tightened with respect to that finger 84, the center punch tool 106 is now squeezed tightly within a distorted bore 64, which now, after tightening by the adjustment bolt 112, now effects a perfect circular hole as the bore 64. By aligning the respective centers "Y" and "Z" of the adjacent holder plates within the upper portion and the lower portion of the die set arrangement, the matable tool components therein may be held in perfect axial alignment, as represented in the earlier referenced patent.

The center punch holder plate 52 comprising the present invention is thus a block or plate having the tool gripping bore 64 extending generally centrally therethrough, as shown in FIGS. 1 and 2. The tool gripping bore 64, now identified more specifically, has a first half circle C1 of arcuate configuration of 180° going from a $1^{st}$ point "A" to a $2^{nd}$ point "B" on that bore 64, as represented in FIG. 2. The $1^{st}$ arcuate configuration C1 has the $1^{st}$ center of curvature "Y". The tool gripping bore 64 has a $2^{nd}$ arcuate configuration C3 of almost a half circle going from the $2^{nd}$ point "B" on that bore 64 to a $3^{rd}$ point "E" on that bore 64. The $2^{nd}$ arcuate configuration C3 extends from $2^{nd}$ point "B" to the $3^{rd}$ point "E" which is slightly less than one hundred and eighty degrees (180°) from the $2^{nd}$ point "B" on the wall of the bore 64.

The $2^{nd}$ arcuate configuration C3 is comprised of a bore-facing-side of the generally "J" shaped finger 84 as identified in the aforementioned patent. That "J" shaped finger 84 being formed by the cut 86 of generally "J" shape through the block or plate 52 as afore described.

The "J" shaped finger 84 has a distal end with a tool-relief bore-facing "sloped away" planar surface 100 thereon, best represented in FIG. 1, beginning at the $3^{rd}$ point "E" on the bore 64, which $3^{rd}$ point "E" is about one hundred and sixty degrees (160°) from the $2^{nd}$ point "B" on the bore 64. The bore facing planar surface 100 is arranged at a slope or angle "M", shown in FIG. 2, of about 10 to 15° with respect to the curvature at the $3^{rd}$ point "E" of the bore 64, and extends to point "Q" at the distalmost end of the "J" shaped finger 84. The "sloped away" planar surface 100, provides a point of relief to facilitate entry of a tool 106 within that bore 64.

The "J" finger-adjustment-bolt 112 may be threaded through the threaded bore 92 on the side of the center punch holder plate 52, as shown in FIGS. 1 and 2, to provide careful inwardly and outwardly releasably biasable adjustment of the "J" shaped finger 84 around a tool 106 within the multicurved non-circular-to-distorted circular bore-to-distorted multicurved non-circular bore 64. When an adjustment bolt 112 abuts against and pushes the "J" shaped finger 84 into close contact with a tool 106 within the bore 64, the two different centers of curvature "Y" and "X" for the respective portions of the bore periphery, are adjustably distortable into common alignment.

Figure 3:
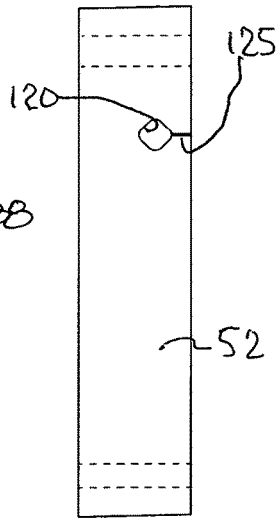
FIG. 3 is first (right shown) side view of the center punch holder plate shown in FIG. 2.

A keyway 120, shown in FIGS. 1, 2 and 3, is arranged through the center punch holder plate 52. which keyway 120 tangentially forms a slight opening 130 in the wall surface of the $1^{st}$ semicircular (non-movable, non-distorted portion 100) configuration of the bore 64. The keyway 120 extends across the center punch holder plate 52 as shown in FIGS. 1 and 2, and is of non-circular configuration, best shown in FIG. 3, so as to minimize surface contact and hence more easily receive a cylindrical key 122, shown in FIG. 1, which key 122 would be pushed therethrough. The non-circular keyway 120 configuration is preferably of generally square shape, however having rounded corners therealong. The non-circular keyway 120 is made within the center punch holder plate 52 by a cutting wire, not shown, which is creates an elongated cut 125 and is maneuvered into the location for the elongated, squareish keyway. The cutting wire would form the generally non-circular transverse shape of the keyway 120 by electrical discharge against the metal of the center punch holder plate 52.

I claim:

1. A tool gripping and alignment plate arrangement, for accurately gripping and holding a tool in alignment, comprising:

a flat unitary tool gripping plate;

an irregular bore wall opening formed in the tool gripping plate, for gripping a tool therein, the irregular bore wall opening comprised of a first wall portion of 180 degrees in circumference, and a distortable second wall portion of less than 180 degrees in circumference, with a bore-facing tool relief portion at an end of the distortable second wall portion; and wherein the first wall portion and the second wall portion each have centers of curvature in alignment when the second wall portion of the irregular bore is in a distorted state.

2. The tool gripping and alignment plate arrangement as recited in claim 1, wherein the first wall portion and the second wall portion each have independent centers of curvature when the first wall portion of the irregular bore is in a non-distorted state.

3. The tool gripping and alignment plate arrangement as recited in claim 1, wherein the second wall portion is and a curvilinear cut extending in a generally J-shape around a portion of the bore opening form a generally "J" shaped biasable member.

4. The tool gripping and alignment plate arrangement as recited in claim 3, wherein an end of the generally "J" shaped biasable member is the bore-facing tool relief portion, wherein the bore-facing tool relief portion has a sloped surface.

5. The tool gripping and alignment plate arrangement as recited in claim 4, wherein the sloped surface of the tool relief portion is arranged at an angle of about 10 to 15 degrees with respect to the distortable second wall portion.

* * * * *